US008441193B2

(12) United States Patent
Obata et al.

(10) Patent No.: US 8,441,193 B2
(45) Date of Patent: May 14, 2013

(54) ELECTRONIC FREQUENCY TUNING MAGNETRON

(75) Inventors: Hideyuki Obata, Fujimino (JP); Kunihiko Takahashi, Fujimino (JP)

(73) Assignee: New Japan Radio Co., Ltd., Tokyo (JP)

( * ) Notice: Subject to any disclaimer, the term of this patent is extended or adjusted under 35 U.S.C. 154(b) by 693 days.

(21) Appl. No.: 12/572,454

(22) Filed: Oct. 2, 2009

(65) Prior Publication Data

US 2011/0057563 A1 Mar. 10, 2011

(30) Foreign Application Priority Data

Sep. 10, 2009 (JP) ..... 2009-209214

(51) Int. Cl.
*H01J 25/50* (2006.01)

(52) U.S. Cl.
USPC .... 315/39.55; 315/39; 315/39.61; 315/39.51; 315/39.57; 331/86; 331/90; 331/96; 331/107 R

(58) Field of Classification Search ..... 315/39, 315/39.55, 39.51, 39.63, 39.75, 39.77, 39.65, 315/39.69; 331/86, 90, 96
See application file for complete search history.

(56) References Cited

U.S. PATENT DOCUMENTS

| | | | | |
|---|---|---|---|---|
| 2,782,342 | A * | 2/1957 | Kilgore | 315/39.57 |
| 3,628,183 | A * | 12/1971 | Strenglein et al. | 331/96 |
| 3,879,682 | A * | 4/1975 | Swartz et al. | 331/96 |

FOREIGN PATENT DOCUMENTS

| | | | |
|---|---|---|---|
| GB | 1382502 | A | 2/1975 |
| JP | 43007664 | Y | 4/1968 |
| JP | 61-067312 | A | 4/1986 |
| JP | 1016119 | A | 1/1989 |
| JP | 4-44716 | Y | 4/1992 |
| JP | 05347541 | A | 12/1993 |
| JP | 2006-100066 | A | 4/2006 |

* cited by examiner

*Primary Examiner* — Douglas W Owens
*Assistant Examiner* — Jonathan Cooper
(74) *Attorney, Agent, or Firm* — Rahman LLC

(57) ABSTRACT

A highly-reliable electronic frequency tuning magnetron comprises an anode for forming a resonant cavity which is segmented into a plurality of spaces in an inner periphery side of a cylindrical anode shell, a cathode provided at the center of the anode shell along its cylindrical axial direction and an exhausted structure having a coaxial central conductor which is connected to the inside of the cavity of the anode shell and is coupled thereto in a high-frequency manner, wherein the coaxial central conductor is externally led through a wall of the exhausted structure via a through-hole and the through-hole is covered by a dielectric portion placed between an external conductor for constituting the coaxial central conductor and the central conductor, wherein a portion of the led coaxial central conductor is conductively connected to a switching element.

4 Claims, 18 Drawing Sheets

ELECTRONIC FREQUENCY TUNING MAGNETRON

BACKGROUND

The present invention relates to an electronic frequency tuning magnetron which oscillates microwaves. More particularly, the present invention relates to a constitution of a magnetron for changing oscillating frequency by external electric signals with a simple configuration.

FIG. 11 shows a basic configuration of a conventional magnetron. In the magnetron, a cathode 1 is provided at the center and an anode shell 2 is concentrically provided outside the cathode 1. A plurality of anode vanes 3 is provided to divide the inner space in a circumferential direction. In other words, the anode vane 3 serves as a positive electrode relative to the cathode 1 and a resonator for determining an oscillating frequency at the same time. Thus, the anode vanes 3 form the resonant cavity with the inner wall of the anode shell 2.

In order to best stabilize the n-mode oscillation of the magnetron, line-shaped conductors called strap 4 in contact with alternate ones of the vanes 3 serving as partitions of the resonant cavity which is segmented into a plurality of spaces as mentioned above. In the magnetron with such configuration, an oscillating frequency is determined by reactance which is configured by both the straps 4 and the segment cavity.

As mentioned above, an oscillating frequency is determined by mechanical configuration in the configuration of the magnetron as shown in FIG. 11. Thus, the oscillating frequency cannot be changed if the reactance which is determined by mechanical configuration is not changed. As a typical practicable frequency tuning means, there is a means configured on the basis of the principle described in p. 562 of "MICROWAVE MAGNETRON", MIT Radiation Laboratory Series. According to the means, frequency can be changed by modifying the reactance of the resonant cavity by inserting a metal into the resonant cavity. In other words, the insertion of the metal into the resonant cavity leads to the increase of the inductance of the resonant cavity. In particular, when the metal is inserted in the vicinity of the front edge of the anode vane 3 serving as a partition of the resonant cavity, the capacitance increases and the oscillating frequency becomes higher as a result.

Besides the above-mentioned resonant cavity, as a means for mechanical modulation, a method in which a metal is advanced to the strap 4 or anode vane 3 is described in p. 569 to 572 of "MICROWAVE MAGNETRON", MIT Radiation Laboratory Series.

Moreover, as described in Japanese Unexamined Patent Publication No. 100066/2006, oscillating frequency can be controlled by providing an external resonant cavity (or external space) at the outside of a tube via a hole (or slit) and adjusting the position of a metal plate (or movable metal piece) provided in the external resonant cavity by mechanically shifting the plate to change the reactance of the resonant cavity from the outside of the tube.

SUMMARY

However, according to the method described in Japanese Unexamined Patent Publication No. 100066/2006, a mechanical movable part is used as a means for changing the frequencies. Therefore, there is a difficulty in providing the movable part within the exhausted external resonant cavity. In addition, responses are delayed in the mechanical frequency changing means having the movable part. So, it is not possible to achieve frequency changes at high speed e.g. a few hundreds nanoseconds when the frequency is changed within 1 pulse, for example.

As an example of an electronic tuning magnetron, there is disclosed a method for changing the frequencies by providing a switching element in a tube of a coaxial magnetron for enabling to change the conductive condition of the switching element provided in the resonant cavity by an external signal, to thereby change the reactance of the resonant cavity as described in Japanese Unexamined Patent Publication No. 133763/1975 and International Publication No. WO 92/020088.

However, the method described in Japanese Unexamined Patent Publication No. 133763/1975 and International Publication No. WO 92/020088 requires a complex switching element or the like to be placed within the exhausted tube and thus there is a problem of difficulty in manufacturing and associated costs. In an exhausted tube such as a magnetron, extra low atmosphere needs to be maintained since the characteristics thereof are readily changed by the decrease the atmosphere due to gas release. Materials which are likely to release a gas cannot be used and the pieces of parts include the vane, anode shell and straps are assembled by brazing with a high temperature. Thus there has been a difficulty in placing a switching element within a tube when the switching element is made of a semiconductor.

In Japanese Unexamined Patent Publication No. 133763/1975, it is described as follows: "The external circular electric mode cavity is exhausted, however it is not necessary". "According to one Example, a conventional casing such as a ceramic cylinder with an airtight electromagnetic wave transmitting property is placed at the outside of an inner wall within the resonator 14. Therefore, the resonator is not exhausted". Thus, reactance load may be imposed on the side of the atmosphere and there is no problem of difficulty in manufacturing and gas releases.

In Japanese Unexamined Patent Publication No. 133763/1975, however, a plurality of reactive load elements for synthesizing and determining resonance frequencies is required. As such, there is a drawback that the effect of the reactance modification from a single load element over the entire frequency modulation is decreased. This is because the typical switching element can only change the reactance of the primary resonant cavity or a portion of the resonator connected to the resonant cavity, and many expensive switching elements need to be used for increasing a variable frequency range.

FIG. 12 shows a resonance circuit of a circular mode magnetron as shown in FIG. 1 of Japanese Unexamined Patent Publication No. 133763/1975. As shown in FIG. 12, a vane resonator and a circular mode resonator are coupled at many places (10 places in FIG. 1), and the frequency is synthesized by the interaction of each reactance to determine the resonance frequency.

In order to modify the reactance of the circular mode resonator, the reactance of the resonator with a wide range needs to be influenced and many reactive load elements need to be provided on the entire circumference to obtain a desired amount of frequency change. Typically, the switching element has a problem in degrading responses relative to bias voltage due to its capacitance. Thus, in the case of using a plurality of switching elements 18*a*, the capacitance thereof increases and thus the frequency cannot be changed in a pulse where high speed responses are required.

In addition, since the switching elements are inserted into a portion of the resonator of the magnetron serving as a synthetic resonant cavity, the resistance part of the cavity impedance significantly increases. Therefore, the inherent characteristics of a resonant Q factor decreases. As shown in FIG. 8 of Japanese Unexamined Patent Publication No. 133763/1975, signals are significantly changed relative to the frequencies. Thus, a diode (switching element) needs to be promptly switched from the nonconductive state to conductive state. Under such circumstances, it cannot be used during the bias state of between the conductive state and nonconductive state, i.e. in the intermediate frequencies. Such significant changes in Q factor result in a problem of degrading spectrum spectra and such problem needs to be solved.

In terms of the reliability and quality aspects of a magnetron, when a switching element is provided in a tube, even if it is placed in the vicinity of a position with the smallest electric field and a largest magnetic field, there may be damage on electric resistance of the switching element due to the generation of a high electric field in the case the magnetron is degraded or anode voltage pulses with significantly fast rising edge are applied. A Q factor is a dimensionless number representing the quality of a resonance circuit as defined by $Q=f0/(f2-f1)$. Here, f0, f1 and f2 represent resonance frequencies at an output peak, a frequency at which the oscillating energy is half of the resonant peak on the left side of the resonant peak and a frequency at which the oscillating energy is half of the output peak on the right side of the resonant peak, respectively. The larger the value performs, the oscillating frequency is more stable in the magnetron.

In terms of the need for frequency tuning, there are a passive reason for keeping the stability relative to the drift of the magnetron and an active reason for applying modulation. With respect to the drift of the oscillating frequency of the magnetron, it is called current pushing characteristics and may be caused in accordance with the magnitude of an anode current. One reason for the frequency drift that the number of electrons are emitted from the cathode changes in accordance with the level of the conducted anode current and the space charge is modified.

In the magnetron, the resonant cavity may generate thermal expansion by the ambient temperature of its location and the heat generated by the magnetron itself. In such a case, there is a phenomenon that the oscillating frequency decreases with a temperature increase and increases with a temperature decrease.

In this way, tuning will be missed since a magnetron has a contributing factor for changing the oscillating frequency. Thus, it is desired to stably perform the variable control of the oscillating frequency.

In addition, in the case of oscillating a microwave signal oscillated with radars by using the magnetron and detecting a reflected signal from an object, the information contained therein is large and the search resolution performance of the radar is dramatically improved. This field has been researched to perform with the solid state which is easily modulated currently. However, a device which can efficiently oscillate high output with the solid state has not been found.

An object of the present invention is to provide a highly-reliable magnetron at low cost which can obtain a frequency tuned high power microwave having a desired frequency with a significant prompt response by using an external electric signal. The magnetron has a simple configuration which does not include a mechanical means having a movable part. The magnetron does not need to be provided with a cylindrical mode resonator with a complex shape at the outside of a conventional anode resonator. The magnetron can also obtain a wide variable range of oscillating frequency without providing a switching element in a tube and waning productivity.

The present invention is characterized by an electronic frequency tuning magnetron comprising: an anode for forming a resonant cavity which is segmented into a plurality of spaces in an inner periphery side of a cylindrical anode shell; a cathode provided at the center of the anode shell along its cylindrical axial direction; and an exhausted structure having a coaxial central conductor which is connected to the inside of the resonant cavity of the anode shell and is coupled thereto in a high-frequency manner; wherein the coaxial central conductor is externally led through a wall of the exhausted structure via a through-hole, and the through-hole is covered by a dielectric portion placed between an external conductor and the central conductor for constituting the coaxial central conductor; wherein a portion of the led coaxial central conductor is conductively connected to a switching element.

Preferably, the led coaxial central conductor and the switching element are connected in such a manner that the high-frequency coupling of the through-hole on the wall of the exhausted structure is short-circuited.

Preferably, the switching element is conductively connected to the portion of the led central conductor, and the coaxial central conductor and the switching element are covered with the coaxial external conductor, and wherein the portion of the coaxial central conductor is led to an outside of the coaxial external conductor for covering the switching element by the conductor without touching an end or both ends of the switching element with the coaxial external conductor.

Preferably, the led coaxial central conductor has capacitance between the conductor and the coaxial external conductor in such manner that the led coaxial central conductor is in communication with the resonant cavity serving as a resonator, and the switching element is connected in such a manner that it is aligned in parallel with the electrodes.

According to the configuration of the present invention, the electrical frequency tuning magnetron can be used by providing a switching element comprising a PIN diode, for example, at the outside of the anode shell (resonant cavity) and the frequencies can be freely changed by an external electric signal.

In addition, according to the configuration of the present invention, the cavity resonator of the magnetron and its outside are coaxially coupled. The high-frequency conductive state of the switching element is thus changed by providing the switching element on the coaxial central conductor and applying bias thereto. Therefore, the reactance is changed due to a greater change relative to the change of the conductive state of the switching element. In consequence, the resonance frequency of the magnetron is changed by receiving the influence thereof.

According to the electrical frequency tuning magnetron of the present invention, high-powered microwaves having a desired frequency can be obtained with a significant quick response by using an external electric signal. The magnetron has a simple configuration which does not include a mechanical means having a movable part. The magnetron can also obtain a wide variable range of oscillating frequency without providing a switching element in a tube and hindering productivity. Therefore, there is an effect that a highly reliable magnetron can be provided with low cost. Furthermore, it is feasible to adjust a frequency drift of the magnetron and to select the frequencies for suppressing interferences. There are also effects of obtaining much of compressed information with low power by modulating pluses and decreasing an occupied frequency bandwidth.

As described above, the electronic frequency tuning magnetron according to Examples does not have manufacturing limitations as an exhausted tube, since the switching element is provided outside the tube. Thus it does not need to be designed on the basis of highly expensive coaxial magnetrons or magnetrons with an old-designed reactive load structure or an external resonant cavity. In consequence, magnetrons with a conventional simple configuration are sufficient for use. In addition, as mentioned above, an oscillation source of microwaves which is usable by freely changing frequencies in a wide range with an external signal can be provided. Therefore, there are advantages that it is feasible to take measures against the frequency drift of the magnetron and to select the frequencies for suppressing interferences.

BRIEF DESCRIPTION OF THE DRAWINGS

FIG. 1(*b*) is a top view showing a configuration of the electronic frequency tuning magnetron according to Example 1;

FIG. 2(*b*) is a top view showing a configuration of the electronic frequency tuning magnetron according to Example 2;

FIG. 3(*b*) is a top view showing a configuration of the electronic frequency tuning magnetron according to Example 3;

FIG. 4(*b*) is a top view showing a configuration of the electronic frequency tuning magnetron according to Example 4;

FIG. 5(*b*) is a view showing a junction of a coaxial central conductor and a vane of the electronic frequency tuning magnetron according to Example 5;

FIG. 5(*c*) is a view showing a junction of a coaxial central conductor and a vane of the electronic frequency tuning magnetron according to Example 5;

FIG. 6(*b*) is a view showing a configuration of the electronic frequency tuning magnetron according to Example 6;

FIG. 6(*c*) is a view showing a configuration of the electronic frequency tuning magnetron according to Example 6;

FIG. 7(*b*) is a top view showing a configuration of the electronic frequency tuning magnetron according to Example 7;

FIG. 8(*b*) is a view showing a configuration of the electronic frequency tuning magnetron according to Example 8;

FIG. 20(*b*) is a top (partially sectional) view showing a configuration of the electronic frequency tuning magnetron according to Example 11;

FIG. 21(*b*) is an elevation view showing a window portion of the electronic frequency tuning magnetron according to Example 12;

DETAILED DESCRIPTION

Figure 1:
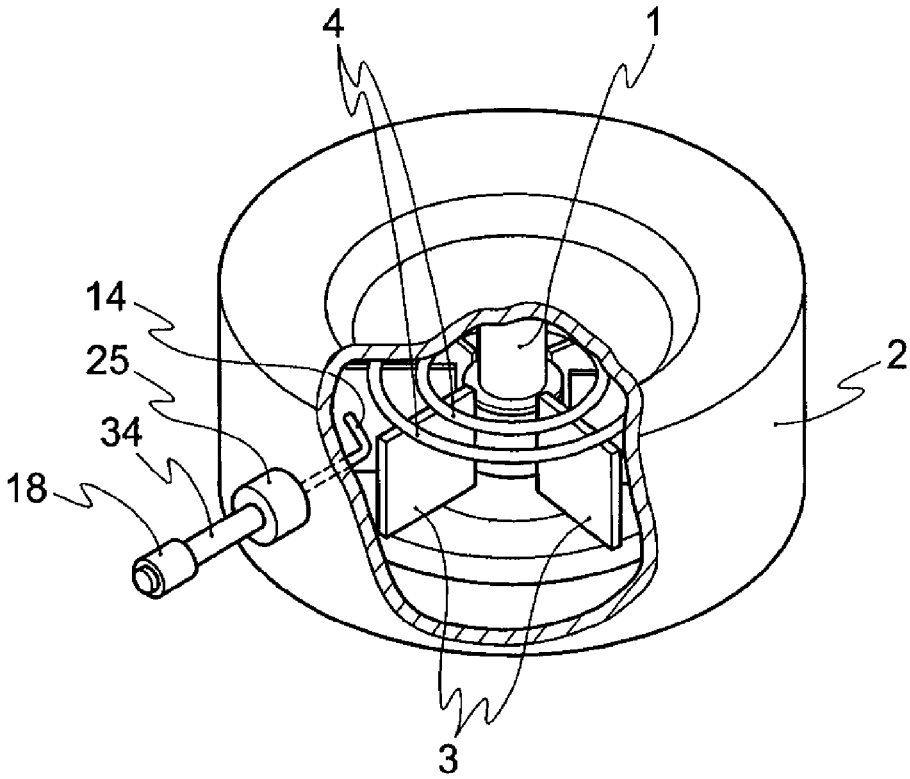
FIG. 1(*a*) is a perspective view showing a configuration of the electronic frequency tuning magnetron according to Example 1.
Figure 1:
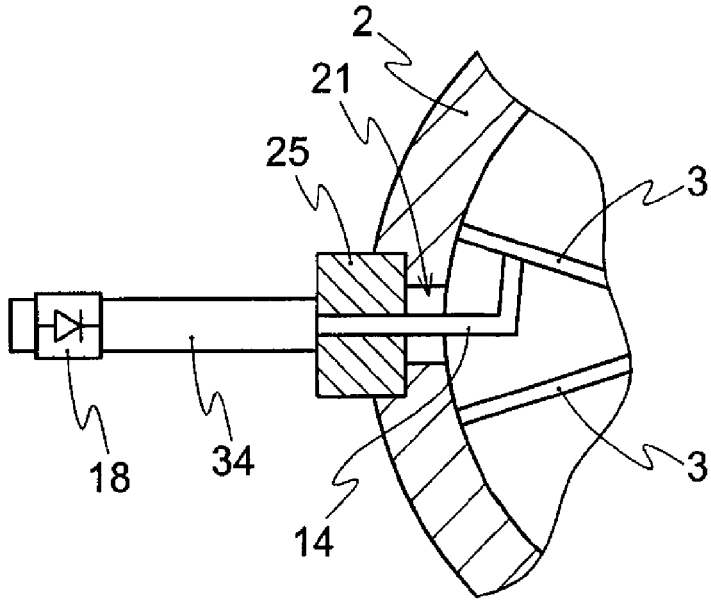

FIG. 1(*a*) and FIG. 1(*b*) show a configuration of an electronic frequency tuning magnetron according to Example 1 of the present invention. In FIG. 1(*a*) and FIG. 1(*b*), the magnetron includes an anode for forming a resonant cavity which is segmented into a plurality of spaces in an inner periphery side of a cylindrical anode shell 2, a cathode 1 provided at the center of the anode shell 2 along its cylindrical axial direction and an exhausted structure (hereinafter, also referred to as magnetron tube) having a coaxial central conductor which is connected to the inside of the resonant cavity of the anode shell 2 and is coupled in a high-frequency manner. In other words, in the electronic frequency tuning magnetron according to Example 1 of the present invention, the cathode 1 is provided at the center thereof sand the anode shell 2 is concentrically provided outside the cathode 1. A plurality of anode vanes 3 is provided in such a manner that they divide the inner space of the anode shell 2 in a circumferential direction. The anode vanes 3 serve as positive electrodes relative to the cathode 1 and as anodes by forming resonant cavities (resonators) with the inner wall of the anode shell 2. In order to best stabilize the n-mode oscillation of the magnetron, straps 4 in contact with alternate ones of the vanes 3 serving as partitions of the above-mentioned segmented resonant cavities.

In Example 1, a coaxial central conductor 14 is inserted into the resonant cavity of the anode shell through a through-hole 21. As shown in FIG. 1(*a*) and FIG. 1(*b*), a dielectric portion 25 is provided at the outside of the through-hole 21 formed inside the wall surface of the anode shell 2 in such a manner that the dielectric portion covers the through-hole 21. The dielectric portion 25 is formed by a dielectric material such as ceramic or glass, for example, and is attached such that the low atmosphere of the magnetron tube is maintained. In the anode shell 2, an end of the coaxial central conductor is connected to the anode vane 3 for coupling with the reactance of the resonant cavity and the other end passes through the dielectric portion 25 to be led to the outside and is connected to a switching element 18 via an external conductor 34. In other words, the dielectric portion 25 is placed between the concentric central portion 14 and anode shell 2 and serves as an insulating dielectric having a coaxial structure. A bias voltage is applied to the other end of the switching element 18. In other words, by configuring the other terminal of the bias as a point with the same electric potential as that of the anode shell 2, the bias current directly flow in the order of the switching element 18, external conductor 34, coaxial central conductor 14, anode vane 3 and anode shell 2. The current direction is determined in the case of using a PIN diode in the switching element 18 since it has a polarity. The bias voltage is applied in accordance with its polarity by the attachment direction of the switching element 18. The bias direction is opposite if a varactor diode is used in the switching element 18.

According to the configuration of Example 1, the bias is supplied between the switching element 18 and anode shell 2. The RF resistance and capacity of the switching element 18 are changed by adjusting the bias current, and the oscillating frequency is changed by changing the coupling of the resonant cavity of the magnetron and the outside.

Figure 12:
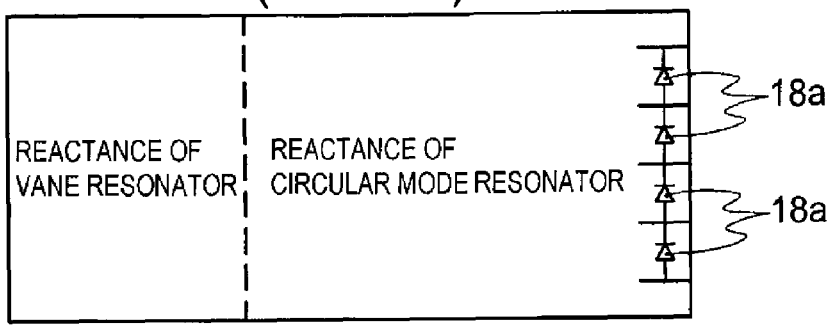
FIG. 12 (Prior Art)
FIG. 12 is an explanatory view showing a conventional magnetron.
Figure 13:
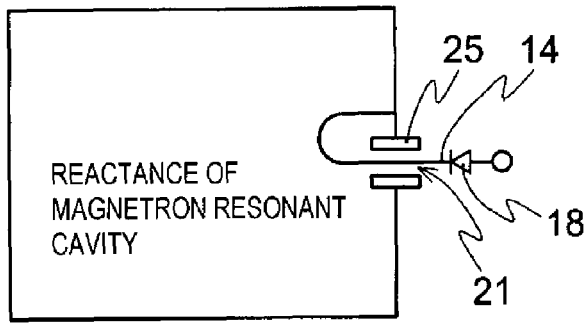
FIG. 13 is an explanatory view showing the magnetron of the present invention.
Figure 14:
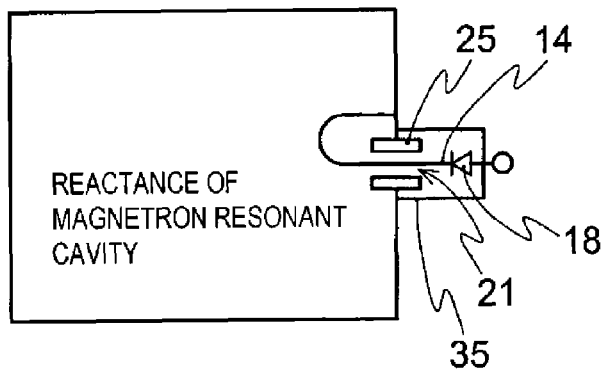
FIG. 14 is an explanatory view showing the magnetron of the present invention.

According to the present invention, the resonant cavity is tightly coupled at a determinate position by the coaxial central conductor. In this way, the resonant frequency of the resonant cavity can be effectively changed by changing the impedance, capacity and conductive states of the tightly coupled coaxial portion. This state is shown in FIG. 13. In FIG. 13, the impedance, capacity and conductive state of the switching element 18 coupled to the coaxial central conductor 14 are changed by the bias current/voltage. When a PIN diode is used in the switching element 18, the conductive state is changed from the conductive state to the nonconductive state by applying a bias current, and the impedance is significantly changed. According to a conventional example shown in FIG. 12, a switching element 18 is internally included in a load structure to change the reactance of the reactive load structure. However, in the case a PIN diode is used in the switching element 18, not only the reactance but the internal resistance thereof is also changed, resulting in a change of the output and coupling factor of the magnetron. In consequence, the magnetron output change, spectrum degradation and pulling characteristics deterioration are generated. In contradiction to this, according to the present invention, since the frequencies can be significantly changed by a single switching element, the internal resistance of the switching element decreases and the change of the output and coupling factor of the magnetron is suppressed. In other words, the present invention enables to change the frequencies without incurring the magnetron output change, spectrum degradation and pulling characteristics deterioration.

Furthermore, stable oscillation output can be obtained even when a bias current is applied to operate the switching element in the semi-conductive state which is the state between the conductive state and nonconductive state.

Figure 2:
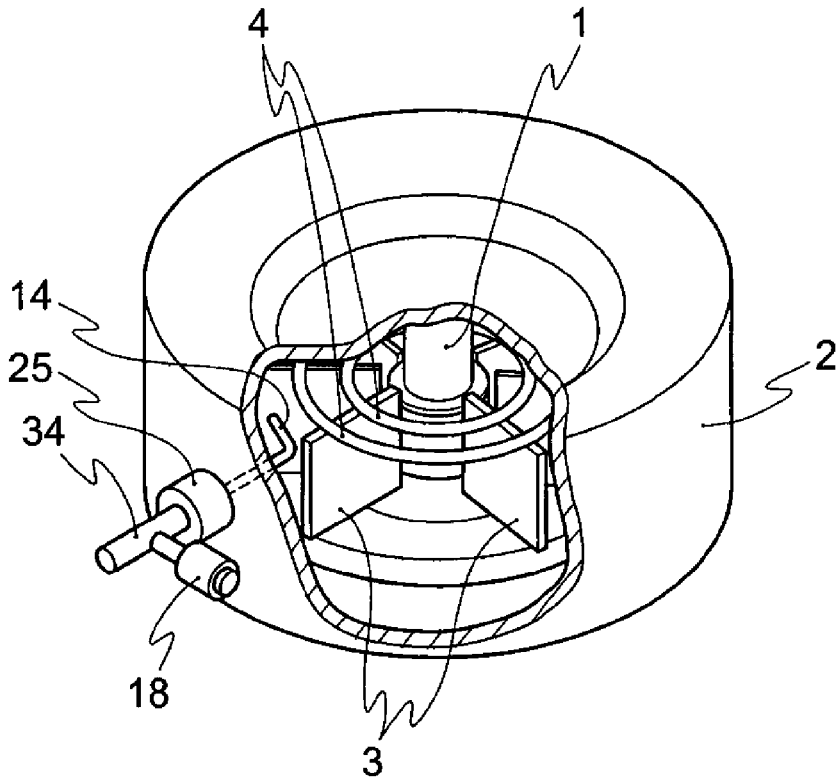
FIG. 2(*a*) is a perspective view showing a configuration of the electronic frequency tuning magnetron according to Example 2.
Figure 2:
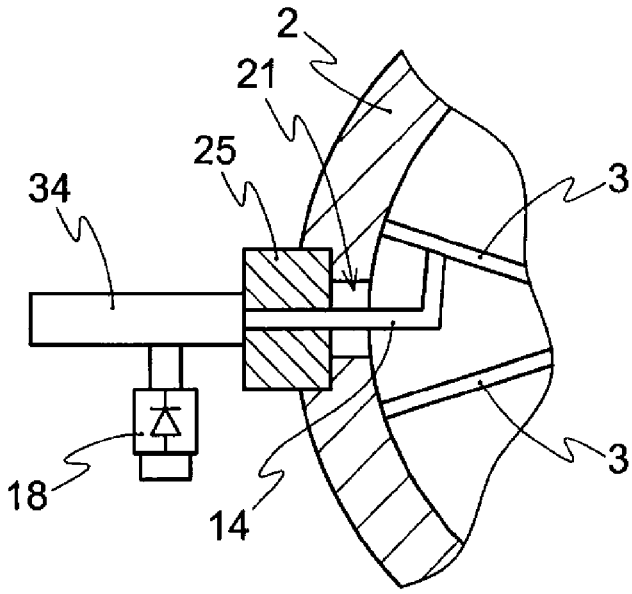

FIG. 2(*a*) and FIG. 2(*b*) show Example in which the switching element 18 is placed at a right angle relative to the external conductor 34 by changing the positional relationship of the switching element 18 and the external conductor 34 while using the same constituent elements as that of FIG. 1(*a*) and FIG. 1(*b*). The switching element 18 is connected serially to the high frequency circuit coupled by the coaxial central conductor 14 in FIG. 1 and is connected in parallel in FIG. 2. In either case, the reactance is changed as a result of the changes in the coupling state and the position of the short circuit in the external conductor 34. As a result, the oscillating frequency of the magnetron is changed.

The vacuum seal of the magnetron tube (i.e. exhausted tube) is maintained by joining the dielectric portion 25 and anode shell 2. As a result, the switching element 18 is located at outside of the exhausted wall and can be attached, including the cover 35, after assembling and exhausting the tube. Since the switching element 18 is not placed within the tube, there is no need to specially consider the gas releases and the damage on the switching element 18 due to the heat from brazing.

Figure 3:
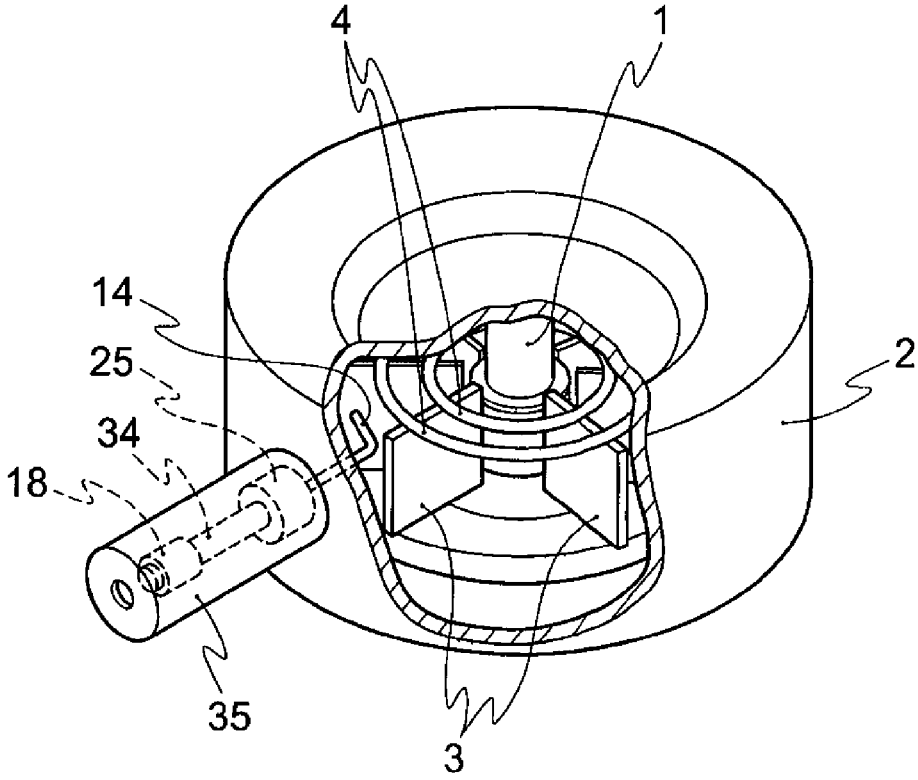
FIG. 3(*a*) is a perspective view showing a configuration of the electronic frequency tuning magnetron according to Example 3.
Figure 3:
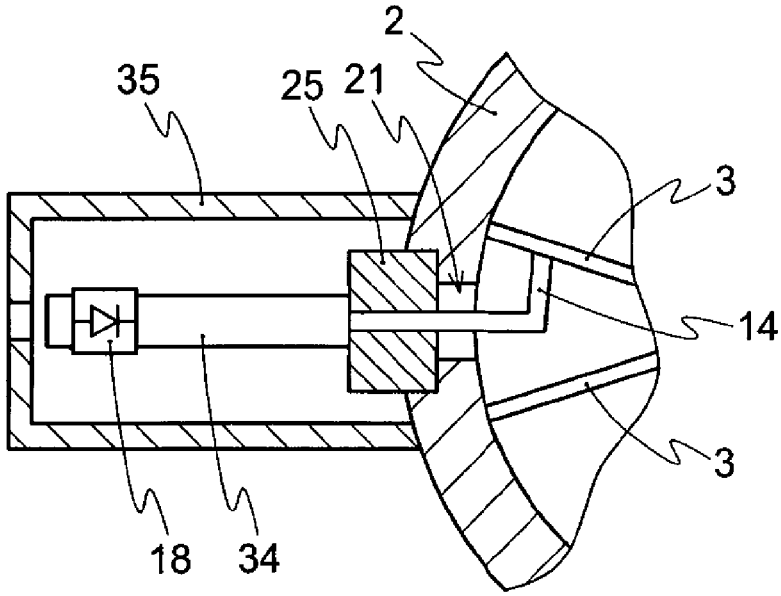

FIG. 3(*a*) and FIG. 3(*b*) show a configuration of the electronic frequency tuning magnetron according to Example 3. In FIG. 3(*a*) and FIG. 3(*b*), a coaxial external conductor 35 is included in addition to the configuration of FIG. 1(*a*) and FIG. 1(*b*). For example, the through-hole 21 is formed on the anode shell 2 serving as a wall of the resonant cavity, and the dielectric portion 25 is attached on the outside of the through-hole 21 in such a manner that the low atmosphere is maintained. The coaxial central conductor 14 penetrates the through-hole 21 and dielectric portion 25 to lead a high-frequency electric field to the outside of the anode shell 2, and is connected to the conductor 34. The coaxial central conductor 14 is coaxial in pairs with the coaxial external conductor 35. The switching element 18 is attached to the conductor 34. Of course, the coaxial central conductor 14 may be extended to serve as the conductor 34. Since the coaxial central conductor 14 is coupled to be led externally, the impedance, capacity and conductive state of the coaxial central conductor 14 including the switching element 18 change depending on the bias conditions, resulting in giving an influence on the oscillating frequency of the magnetron. As a result, if the bias is applied to the switching element 18 through a portion of the coaxial external conductor 35, the resonance frequency of the anode can be changed as mentioned above. In the case a varactor diode is used in the switching element 18 in place of a PIN diode, the resonance frequency can be changed by the change of the capacity. By utilizing such principle, the frequency change is achievable by selecting the attachment position of the switching element 18. The attachment position is selected by considering factors such as the appropriateness of frequency variable level, fewer effects on the changes in the output coupling factor as a magnetron and the compactness of the configuration. There is no problem in the direct current even when the conductor 34 is coupled to the inner wall of the coaxial external conductor 35.

Figure 4:
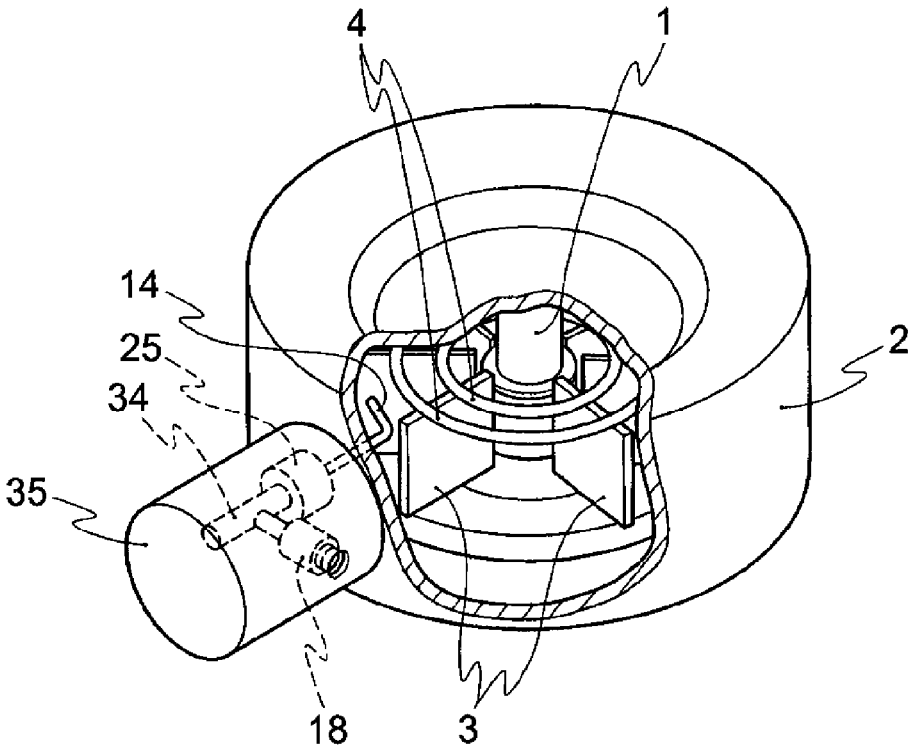
FIG. 4(*a*) is a perspective view showing a configuration of the electronic frequency tuning magnetron according to Example 4.
Figure 4:
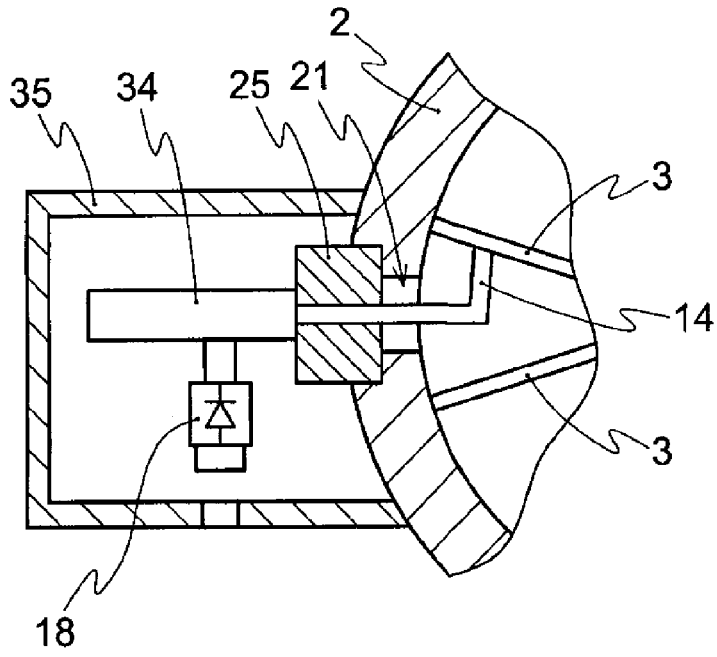

FIG. 4(*a*) and FIG. 4(*b*) show a state in which the microwaves led by the coaxial central conductor 14 do not leak to the outside by extending the coaxial external conductor 35. By extending the coaxial external conductor 35, the shielding effect against the leakage and the shielding effect from the influence when an external metal or dielectric is approximated to the coaxial central conductor 14 or switching element 18 are obtained.

Figure 5:
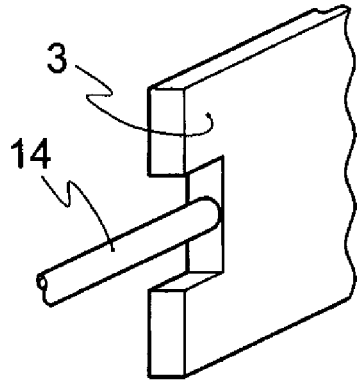
FIG. 5(*a*) is a view showing a junction of a coaxial central conductor and a vane of the electronic frequency tuning magnetron according to Example 5.
Figure 5:
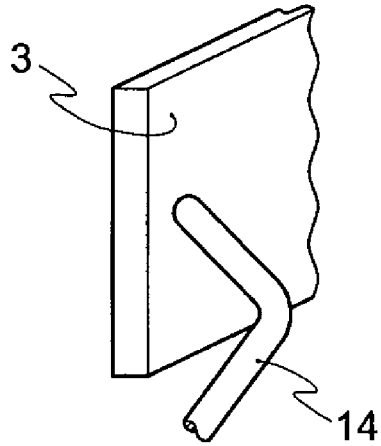
Figure 5:
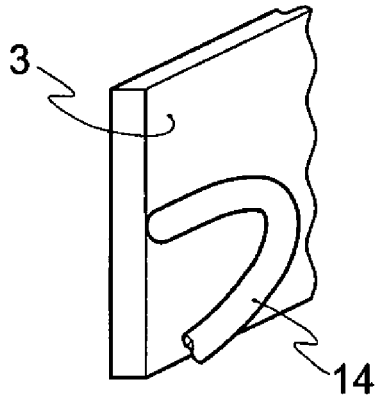

FIG. 5(*a*) to FIG. 5(*c*) show configurations of the magnetron according to Example 5. In Example 5, the shapes of the end of the coaxial central conductor 14 according to Examples 1 and 2 are shown. As shown in FIG. 5(*a*) to FIG. 5(*c*), there is no problem when the end has a loop shape or the end is directly connected to the inner wall of the anode vane 3 or anode shell 2 if an electric field is coupled. The coupling factor may be changed by selecting the loop shape or the position of junction based on the level of the frequency variable amount or other characteristics.

In the above-mentioned Example 1 to Example 5, it has been confirmed that the switching element 18 may be configured by a PIN diode, for example. The level of coupling with the tube inside may be adjusted by the diameters of the through-holes 21, 11 or the coaxial central conductor 14, the loop size or the connecting position with the anode shell 2 or anode vane 3. The oscillating frequency was changed without causing the damage to switching element by the electric field.

Figure 6:
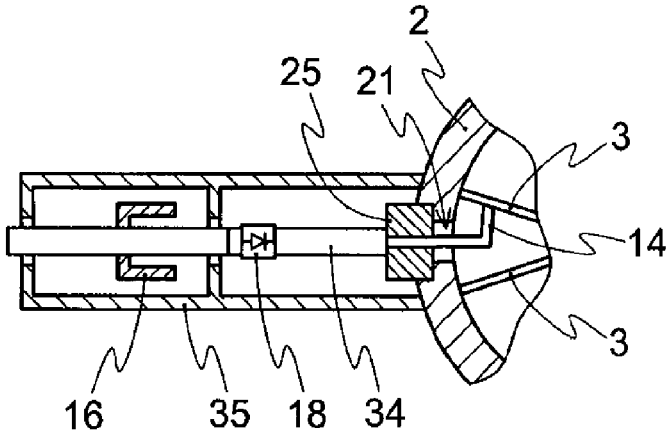
FIG. 6(*a*) is a view showing a configuration of the electronic frequency tuning magnetron according to Example 6.
Figure 6:
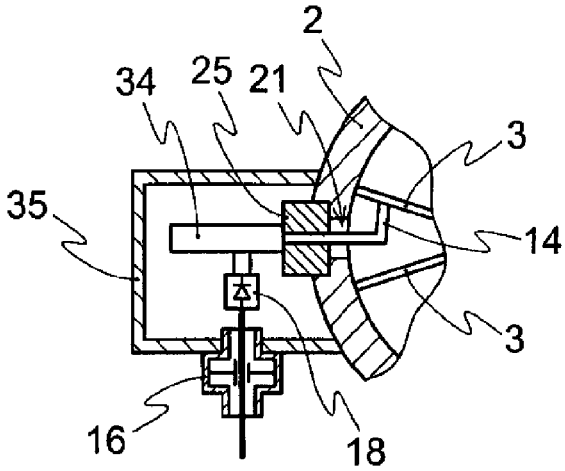
Figure 6:
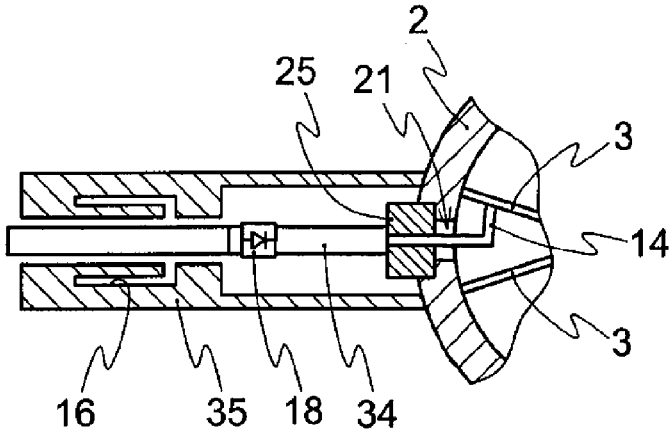

FIG. 6 is Example in which a filter 16 is attached to Example 3 or Example 4 or a combination of Example 3 or Example 4 and Example 5. The filter 16 is attached in such a manner that the high frequency electric field coupled by the coaxial central conductor 14 does not affect the bias circuit through the conductor 34 and switching element 18 when the magnetron oscillates. The filter 16 needs to shield the oscillating frequency of the magnetron but to pass a certain level of microwave in order not to drop the responses of the bias current. For example, when an oscillating frequency of the magnetron is modulated in a pulse, a response with a few nanoseconds is needed. If frequency transformation is performed, the response is transformed to a few hundreds megahertz. The filter needs to be designed such that it can pass such frequencies. The filter shown in FIG. 6(*a*) to FIG. 6(*c*) has a choke structure and does not damage the responses of the bias current when the filter is designed in accordance with the oscillating frequency of the magnetron. Moreover, in a filter including L or C, it is possible to separate the oscillating frequency from the frequencies needed for responses.

Figure 7:
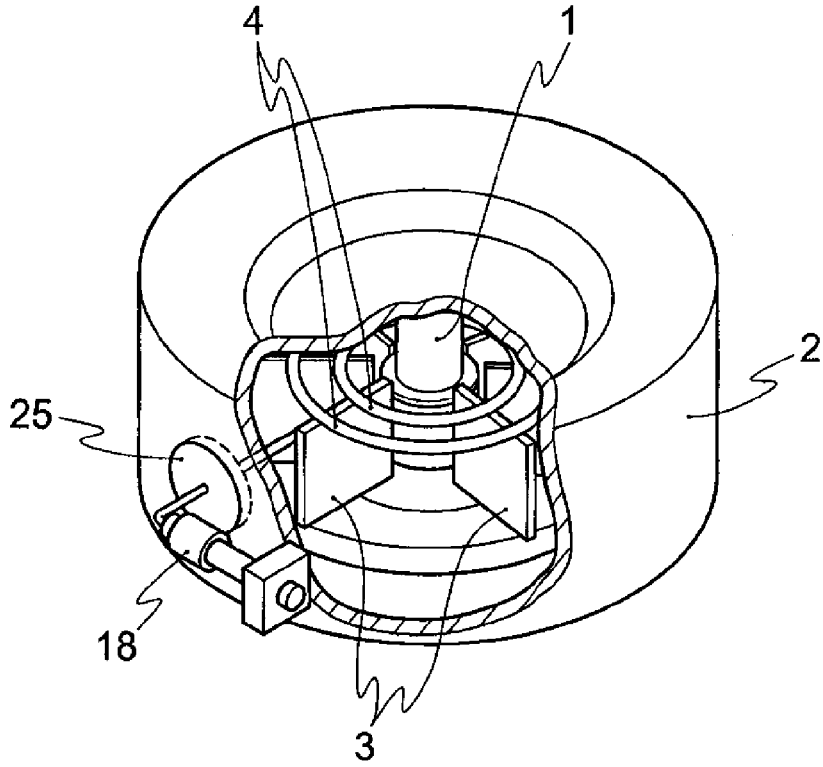
FIG. 7(*a*) a perspective view showing a configuration of the electronic frequency tuning magnetron according to Example 7.
Figure 7:
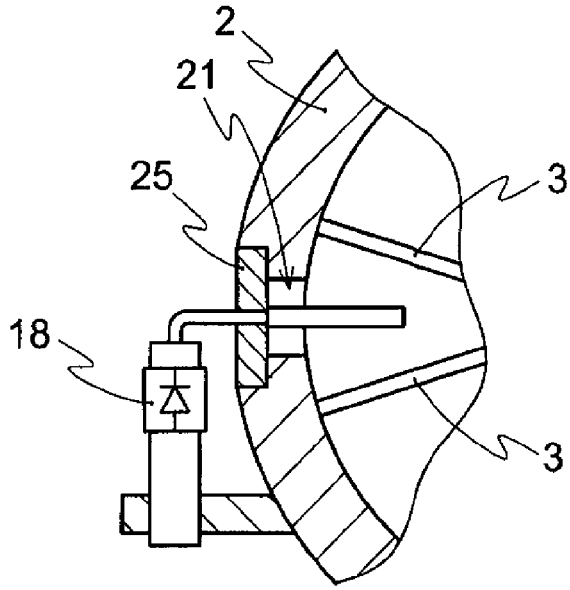
Figure 15:
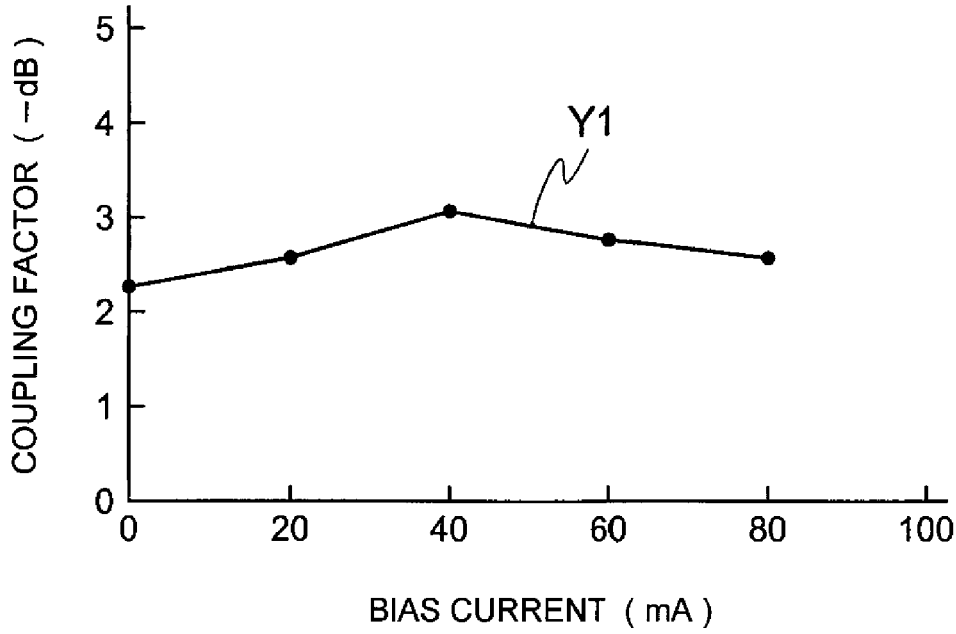
FIG. 15 is a graph showing the relationship between the bias current and coupling factor when a PIN diode is used in a switching element.
Figure 16:
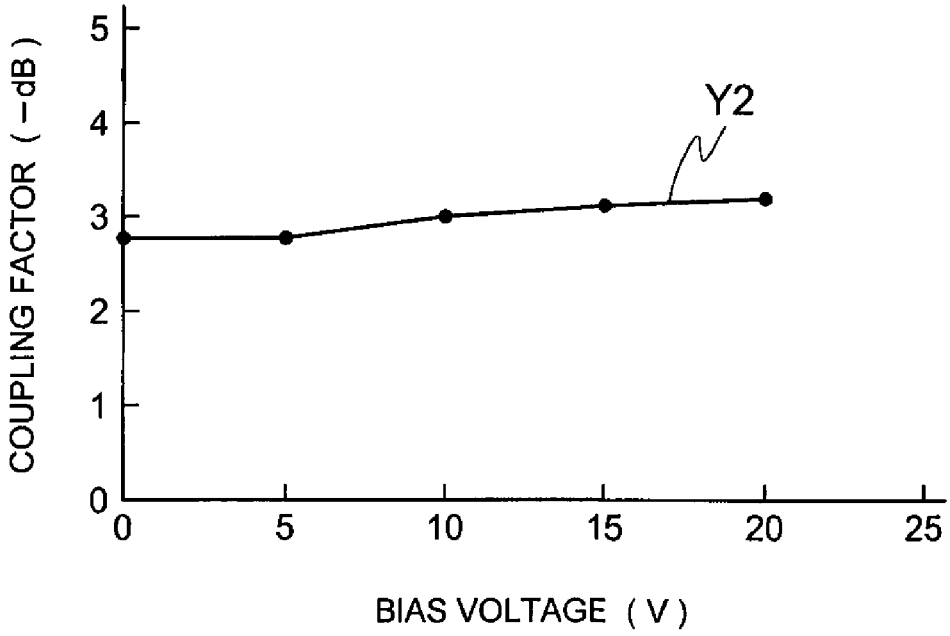
FIG. 16 is a graph showing the relationship between the bias current and coupling factor when a varactor diode is used in a switching element.

In the above-mentioned explanation, the switching element 18 is not limited, but a PIN diode may be typically used since the reactance of the switching element is changed by the bias current. However, the internal resistance is also changed in addition to the reactance when the bias current flows. As mentioned above, however, since changes in the internal resistance are kept to be small, the changes of the coupling factor are suppressed, and the effectiveness is greater according to the present invention as compared to that of conventional examples. In order to further suppress the changes of the coupling factor, a varactor diode, varicap diode or variable-capacitance diode may be used in place of the PIN diode. This is shown in FIG. 15 and FIG. 16. FIG. 15 is a graph Y1 showing the relationship between the bias current and coupling factor when a PIN diode is used in the switching element and FIG. 16 is a graph Y2 showing the relationship between the bias current and coupling factor when a varactor diode is used in the switching element. Those diodes have small resistance changes and large reactance changes when the bias voltage is applied. The polarity of the bias voltage application is opposite to the PIN diode as shown in FIG. 7(*b*).

Figure 8:
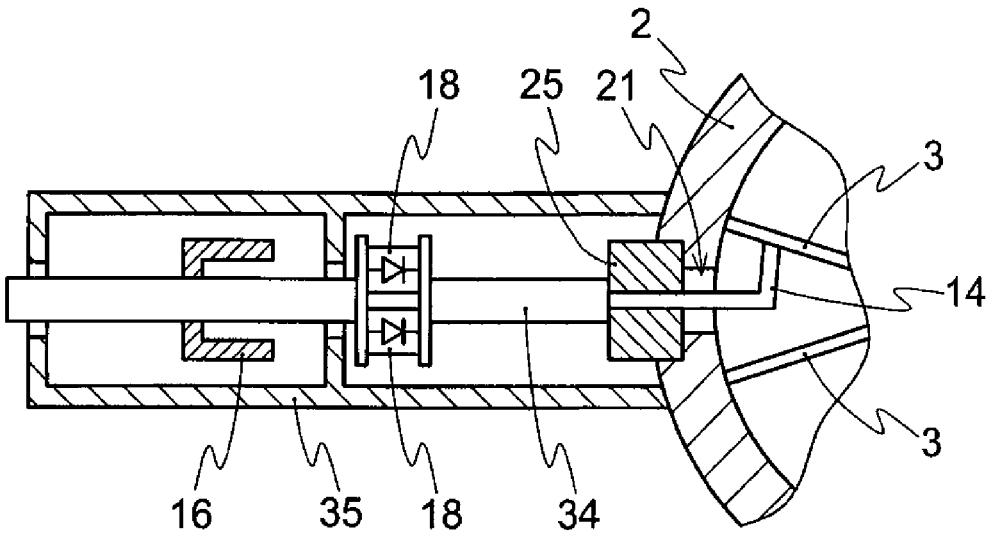
FIG. 8(*a*) is a view showing a configuration of the electronic frequency tuning magnetron according to Example 8.
Figure 8:
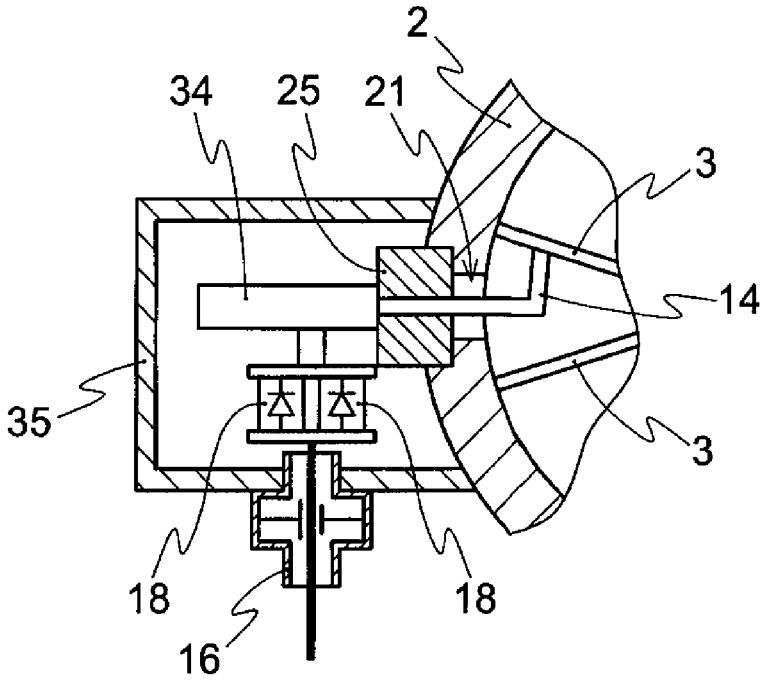

FIG. 8(*a*) and FIG. 8(*b*) show Example 8 in which the switching elements 18 are placed in parallel. In the case the capacity is changed by the bias particularly as in the case of using the varactor diode, the variable range of the capacity increases and the range of the oscillating frequency of the magnetron increases as a result.

Figure 9:
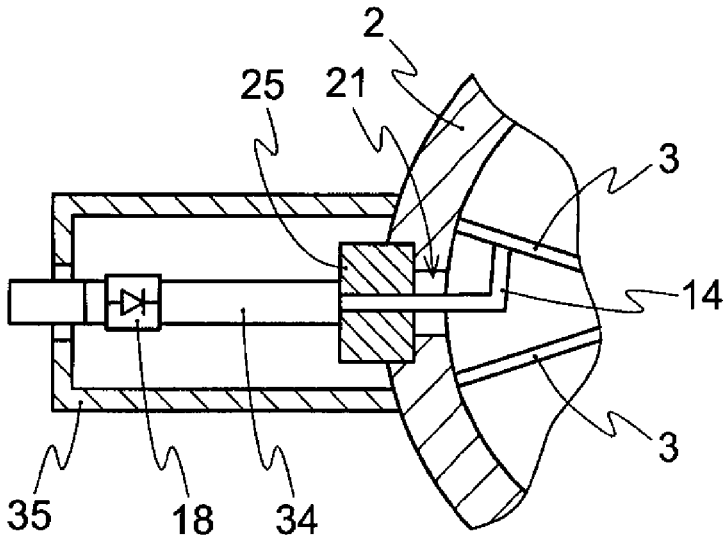
FIG. 9 is a view showing a configuration of the electronic frequency tuning magnetron according to Example 9.

FIG. 9 shows an attachment phase of the switching element 18 according to Example 9 for obtaining excellent frequencies or responses.

Figure 10:
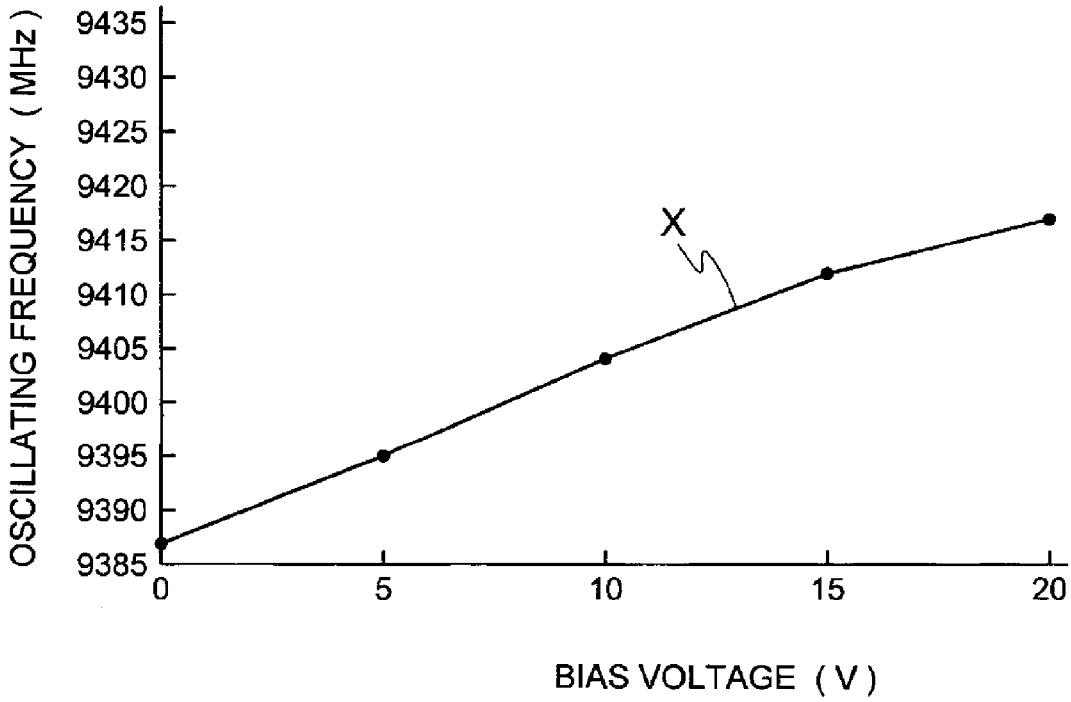
FIG. 10 is a graph showing the relationship between the bias voltages and oscillating frequency when using varactor diode.

FIG. 10 is a graph showing the relationship between the bias voltages and oscillating frequency when a varactor diode is used.

Figure 11:
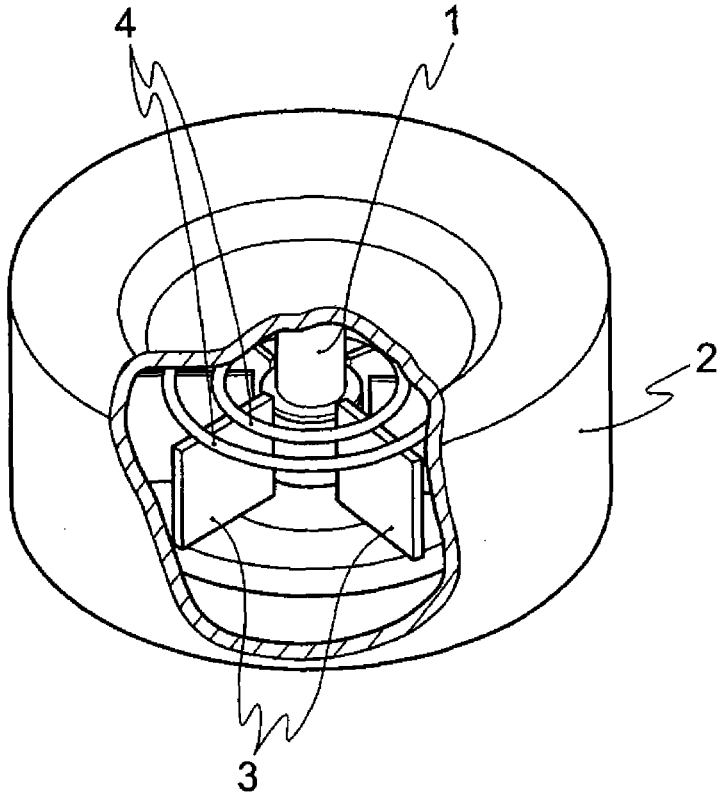
FIG. 11 (Prior Art)
FIG. 11 is a view showing a configuration of a conventional magnetron.
Figure 17:
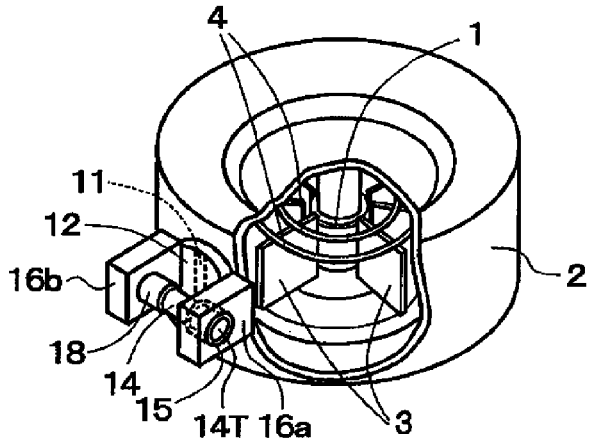
FIG. 17 is a perspective view showing a configuration of the electronic frequency tuning magnetron according to Example 9.
Figure 18:
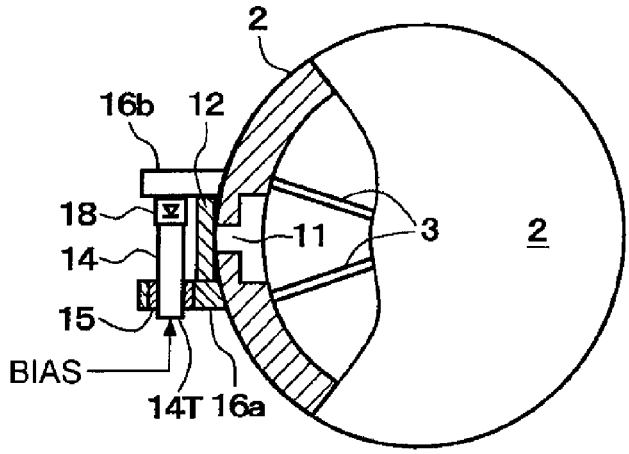
FIG. 18 is a top (partially sectional) view showing a configuration of the electronic frequency tuning magnetron according to Example 9.

FIG. 17 and FIG. 18 show a configuration of the electronic frequency tuning magnetron according to Example 9. In the same manner as the basic configuration shown in FIG. 11, in the magnetron according to FIG. 1, the cathode 1 is provided at the center thereof and the anode shell 2 is concentrically provided outside the cathode 1. The plurality of anode vanes 3 is provided in such a manner that they divide the inner space of the anode shell 2 in the circumferential direction. The anode vanes 3 serve as positive electrodes relative to the cathode 1 and form resonant cavities (resonators) with the inner wall of the anode shell 2. In order to best stabilize the π-mode oscillation of the magnetron, straps 4 in contact with alternate ones of the vanes 3 serving as partitions of the above-mentioned segmented resonant cavities.

In Example 9, a through-hole 11 is formed on an anode shell 2 serving as the wall of the resonant cavity, for example. In order to maintain the low atmosphere (airtight condition) of the resonant cavity (magnetron tube) by covering the outside of the through-hole 11, a window 12 formed from a low dielectric loss material such as ceramic or glass is provided. A metal rod (metal bar) 14 is provided at the outside of the window 12 in such a manner that the rod covers a portion of the front of the window 12. An end of the rod 14 is supported on the anode shell 2 via an insulator 15 by a support (metal) 16*a* in an electrically insulating manner and this end also serves as a terminal 14T to which the bias voltage is applied. To the other end of the rod 14, an end of the switching element 18 including a PIN diode is connected. This other end of the switching element 18 is electrically connected (short-circuited) to the anode shell 2 by a support (metal) 16*b*.

According to Example 9 with such configuration, the electric field of the resonant cavity extends externally through the through-hole 11 and the window 12. Generally, when the bias current is not flowing, the switching element 18 is turned off and the rod 14 is placed apart from the electric potential of the anode shell 2. Thus the extended electric field is not blocked and the oscillating frequency increase above those of the original resonant cavity. In other words, the reactance of the external tube affects on the reactance of the anode shell 2 which is a tube.

Subsequently, when the bias current is applied and the bias voltage is applied between the anode shell 2 and terminal 14T in order to turn on the switching element 18, the rod 14 is short-circuited with the anode shell 2 in a high-frequency manner. The switching element 18 and rod 14 block the electric field extended from the window 12 while increasing the RF resistance with the increase of the bias current. As a result, the oscillating frequency decreases as the increase of the bias current. As one of the conventional methods, another resonator is coupled to the primary resonator of the magnetron, and the reactance of the coupled resonator is changed to thereby change the oscillating frequency. In the configuration of the present invention, however, the oscillating frequency is not changed by coupling another resonator. The oscillating frequency of the single resonant cavity is changed by changing the electric field extended from the resonant cavity (coupling factor of the window 12) without providing another resonator.

Figure 19:
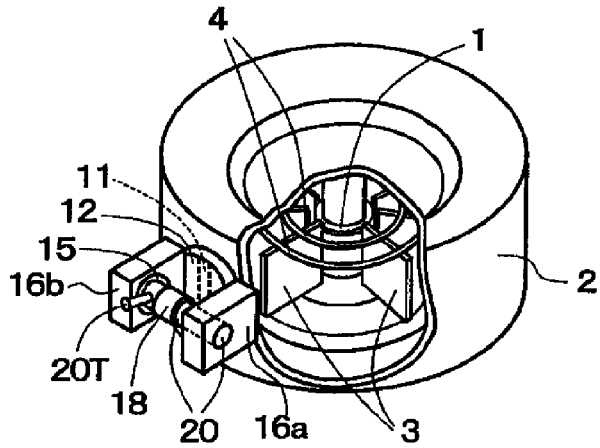
FIG. 19 is a perspective view showing a configuration of the electronic frequency tuning magnetron according to Example 10.

FIG. 19 shows a configuration of the magnetron according to Example 10. In Example 10, a short-circuit position of the metal rod relative to the anode shell is changed. In other words, the switching element 18 is provided along with the rod 20, and one end of the rod 20 at the side of the support 16*b* is connected apart by placing an insulator 15 in between and serves as a bias applying terminal 20T. The other end of the rod 20 is electrically connected to the anode shell 2 via the support 16*a*. In Example 10, the oscillating frequency can be modulated by flowing the bias current from the terminal 20T to the switching element 18 in the same manner as in Example 1.

Figure 20:
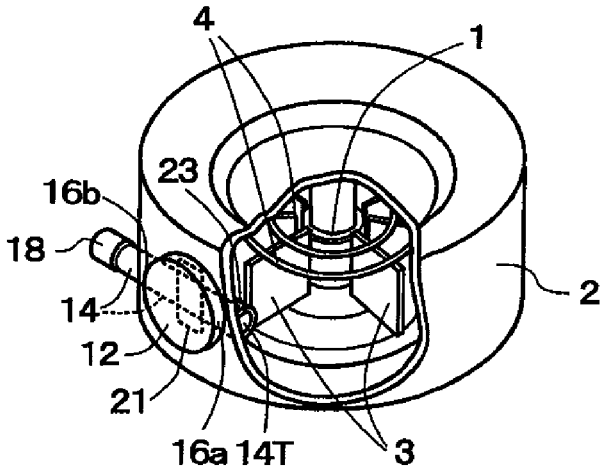
FIG. 20(*a*) is a perspective view showing a configuration of the electronic frequency tuning magnetron according to Example 11.
Figure 20:
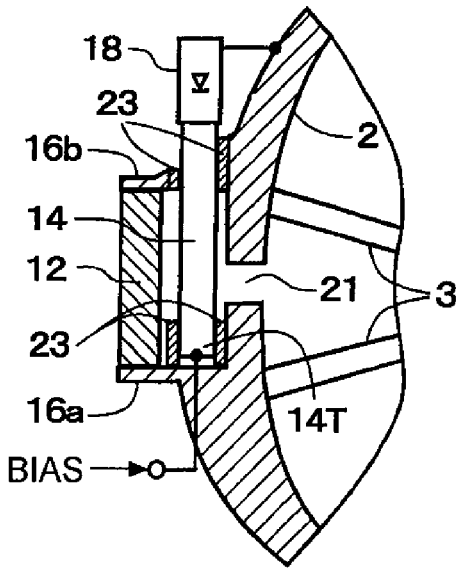

FIG. 20(*a*) and FIG. 20(*b*) show a configuration of the magnetron according to Example 11. In Example 11, the metal rod is placed within the anode shell. As shown in FIG. 20(*a*) and FIG. 20(*b*), the through-hole 21 is provided on the wall of the anode shell 2 forming the resonant cavity and the window 12 formed by a low dielectric loss material is provided on the outside of the through-hole 21. The window 12 is provided in such a manner that airtight condition for maintaining the low atmosphere of the resonant cavity is maintained. The metal rod 14 is inserted between the window 12 and through-hole 21 on the wall from the outside of the anode shell 2. The rod 14 is placed in the electric field extended from the through-hole 21 (in such a manner that the rod covers a portion of the through-hole 21 and window 12).

The rod 14 is received by an insulator 23 positioned in the manner as shown in the figure. The rod is supported by such as the support 16*b* by being insulated from the anode shell 2. One end of the rod 14 at the side of the support 16*a* serves as a terminal 14T for applying the bias. The other end of the rod 14 is exposed externally such that one end of the switching element 18 is connected to the exposed end. The other end of the switching element 18 is electrically connected to the anode shell 2 (or connected to the anode shell 2 via the support 16*b*).

In Example 11, the electric field extended through the through-hole 21 and the window 12 can be changed by applying the bias from the terminal 14T to turn on/off the switching element 18 and applying the controlled bias current to the rod 14. Therefore, the oscillating frequency can be modulated in the same manner as in Example 9.

Figure 21:
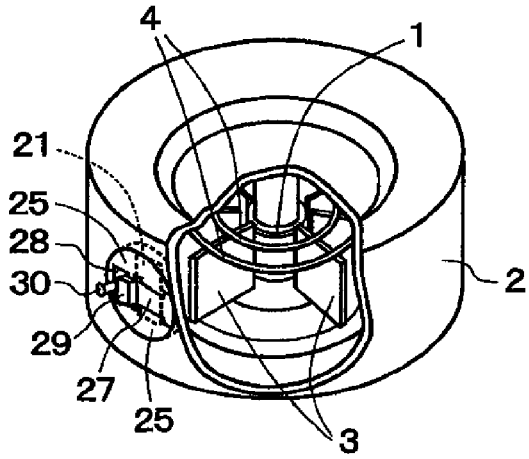
FIG. 21(*a*) is a perspective view showing a configuration of the electronic frequency tuning magnetron according to Example 12.
Figure 21:
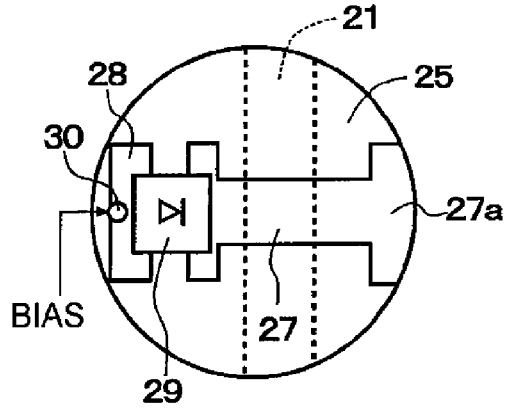

FIG. 21(*a*) and FIG. 21(*b*) show a configuration of the magnetron according to Example 12 in which a metal pattern is formed on the window. In Example 12, the window 25 which covers the through-hole 21 is provided at the outside of the through-hole 21 formed on the inner side of the wall of the anode shell 2 (in the same manner as the window of FIG. 7(*a*)). The window 25 is formed by a dielectric substrate (which is also a low dielectric loss material) formed from such as ceramic, for example, and is provided in such a manner that the low atmosphere of the magnetron tube is maintained. As shown in FIG. 21(*b*), a band-shaped (line-shaped) metal pattern 27, which can be a replacement of a metal bar, is formed on the surface of the window 25 serving as a dielectric substrate in such a manner that the pattern covers a portion of the through-hole 21 and window 25. A switching element 29 is mounted between an end of the band-shaped metal pattern 27 and a terminal portion (metal pattern) 28. A terminal 30 for applying the bias to the terminal portion 28 is attached. The other end of the band-shaped metal pattern 27 is short-circuited to the anode shell 2.

According to such Example 12, bias current flows from the switching element 29 to the metal pattern 27 by applying a bias voltage between the terminal 30 and the anode shell 2. By controlling the amount of the current, the extended electric field is changed. Therefore, the oscillating frequency can be changed.

FIG. 7(*b*) shows a configuration according to Example 7. In Example 7, a metal body is inserted to the resonant cavity of the anode shell through the window. As shown in FIG. 7(*b*), a window 25 for covering the through-hole 21 is provided at the outside of the through-hole 21 formed inside the wall of the anode shell 2, for example. The window 25 is formed from a low dielectric loss material such as ceramic or glass, for example, and is provided in such a manner that the low atmosphere of the magnetron tube (resonant cavity) is maintained. A metal probe (metal body) 32 is provided so as not to contact with the constituents of the resonant cavity in the anode shell 2. The probe 32 is led to the outside of the tube through the window 25 by a metal wire 33, and the other end of the metal wire 33 is connected to the switching element 18 via the terminal 34. The other end of the switching element 18 is electrically connected (short-circuited) to the anode shell 2 by the support (metal) 35.

According to the configuration of Example 7, when a bias is applied to the switching element 18 between the anode shell 2 and the terminal 34, the inductance in the resonant cavity of the anode shell 2 changes by the presence of the probe 32. As a result, the oscillating frequency can be changed. Accordingly, by adjusting the bias current to the switching element 18, the oscillating frequency can be controlled in the same manner as in Example 9.

In Example 9 to Example 12, in the case of adopting a magnetron with an X-band, the through-holes 11, 21 are formed to have a rectangular or circular shape with the height of 4 to 10 mm and the width of 0.6 to 5 mm to extend the electric field. The windows 12, 25 may be formed with a material with low dielectric loss at the oscillating frequency. Preferably, the thickness of the windows 12, 25 is approximately 0.3 to 3 mm to have a mechanical strength to the pressure for maintaining the low atmosphere. Preferably, the diameter of the rods 14, 20 is approximately 0.5 to 2.5 mm. A PIN diode is used in the switching element 18 such that it can operate under a low voltage of 10 V or less.

Figure 22:
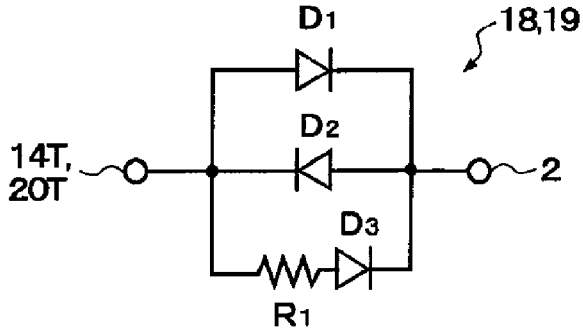
FIG. 22 is a circuit diagram showing a configuration of the switching element according to Examples.

FIG. 22 shows an example of the above-mentioned switching element 18. As shown in the figure, the switching element 18 is formed by placing a PIN diode D1, PIN diode D2, resistance R1, and PIN diode D3 in parallel, for example. A fast switching characteristic is obtained by such switching element 18 and a quick response of a few tens ns can be achieved by applying a bias voltage. Such quick response could not be achieved in the condition where many switching elements were used and capacitance was high as in a conventional manner. As to the variable range of frequencies according to Example, a variable range of 30 MHz or more can be obtained under the above-mentioned configuration. Therefore, a sufficient variable range of frequencies can be obtained without changing a wide range of reactance by using a number of switching elements as in a conventional manner.

Figure 23:
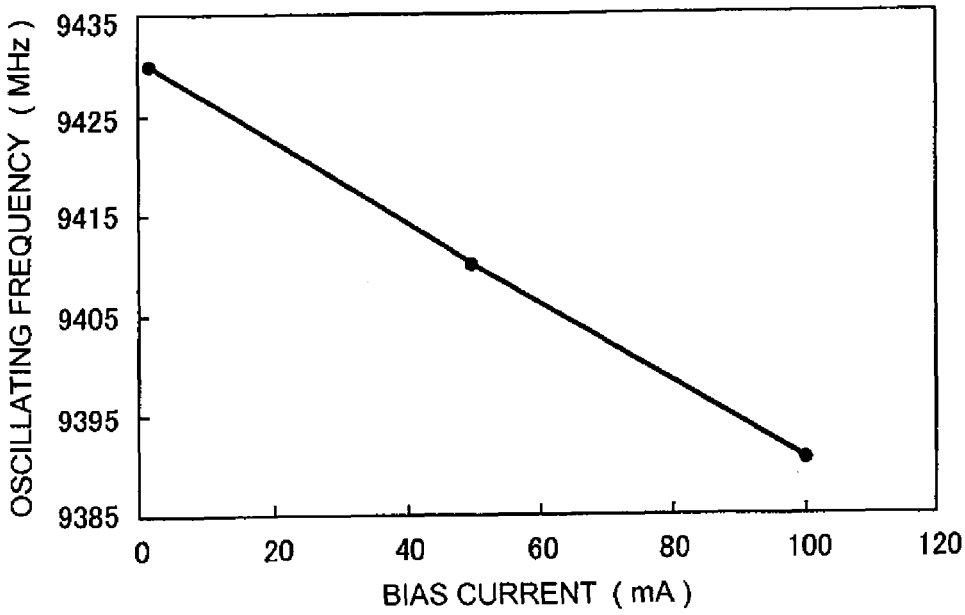
FIG. 23 is a graph showing the relationship between the bias current and oscillating frequency in the electronic frequency tuning magnetron according to Examples.

FIG. 23 shows changes between a bias current (mA) and oscillating frequency (MHz) according to one Example. This is an example when a bias voltage is applied to an electronic frequency tuning magnetron with an X-band. As shown in the figure, the frequency was changed by 40 MHz. The current needed for controlling (changing) the bias current is approximately 100 mA and is significant small. Therefore, it is feasible to make a circuit for control.

Figure 24:
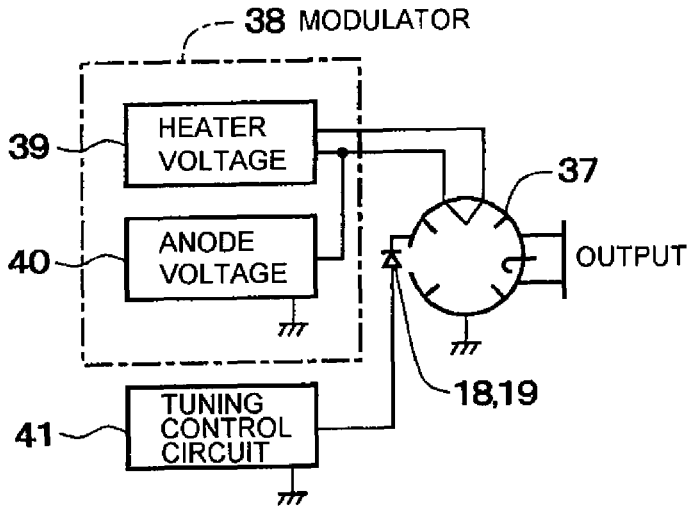
FIG. 24 is a circuit diagram showing an example of bias control (drive) circuit of the electronic frequency tuning magnetron according to Examples.

FIG. 24 shows an example of a bias control (driving) circuit when the electronic frequency tuning magnetron of the above-mentioned example is used in such as radars. To the electronic frequency tuning magnetron 37 of the example, a heater voltage source 39 and anode voltage source 40 of a modulator 38 are connected to perform self oscillation. In many cases, microwave outputs used in radars are pulses, and an anode voltage is modulated by pulses in the modulator 38. By obtaining a signal which is synchronized with the pulse voltage and changing the bias current for tuning in accordance with a synchronizing signal in a tuning control circuit 41, microwave output whose frequencies are changed within pulses is oscillated in the electronic frequency tuning magnetron 37. In other words, modulated microwave output can be obtained.

Figure 25:
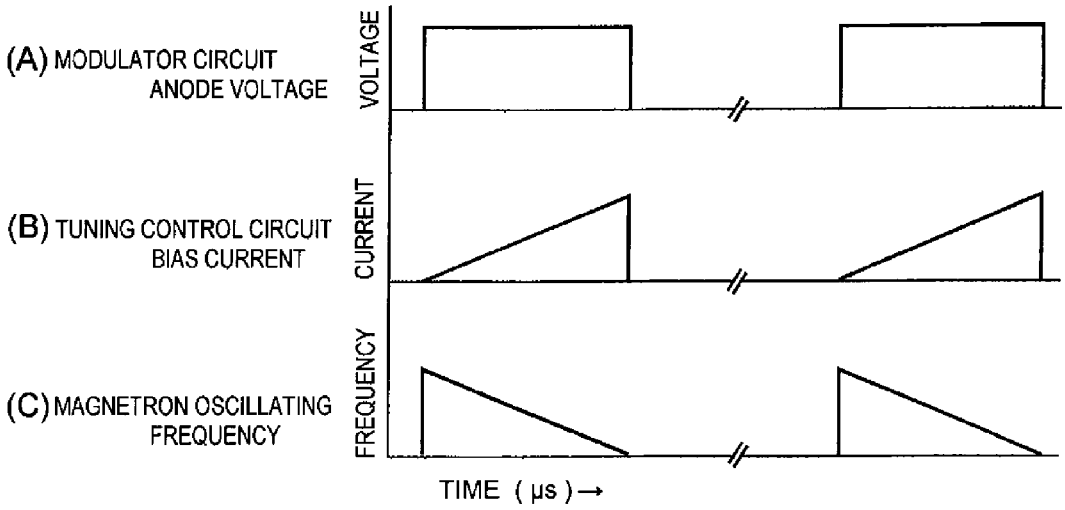
FIG. 25 is a waveform chart showing operation of the modulator, tuning control circuit and electronic frequency tuning magnetron according to the example of FIG. 24.

FIG. 25 shows waveforms of the modulator, turning control circuit and electronic frequency tuning magnetron according to the example of FIG. 24. As shown in (A), an anode voltage from the modulator 38 is applied to the magnetron 37 by pulses. As shown in (B), at the same time, a control voltage changed to such as a serrate form is applied to the switching elements 18, 29 based on the signal which is synchronized with the anode voltage pulses from the tuning control circuit 41. As a result, as shown in (C), an oscillating frequency changed in a serrate form having a backward sloping relative to that of (B) is obtained in the magnetron 37. In the above-mentioned tuning control circuit 41, it is possible to form control voltages whose waveforms other than the serrate-formed waveforms are freely changed by using a synchronized signal. Therefore, modulating frequencies of the electronic frequency tuning magnetron 37 can be arbitrarily changed. According to such configuration, it is possible to provide such as radars, by which much compressed information can be obtained by modulating pulses with low power. Furthermore, a narrower occupied bandwidth can also be obtained.

Figure 26:
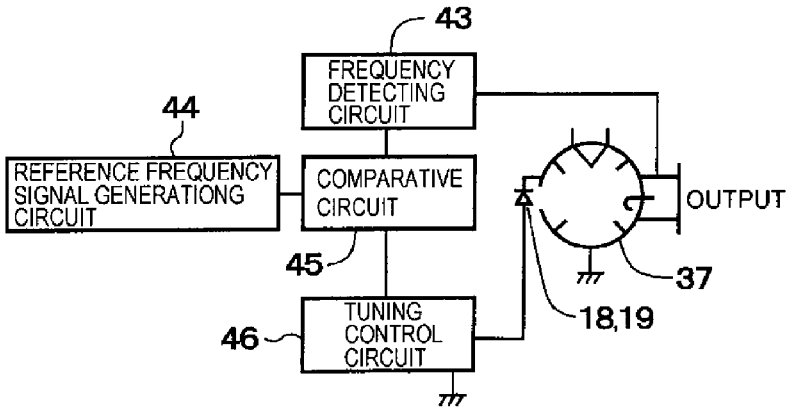
FIG. 26 is a circuit diagram showing another example of the bias control circuit of the electronic frequency tuning magnetron of Examples.

FIG. 26 shows another example of the bias control circuit of the electronic frequency tuning magnetron of the above-mentioned example. According to the example, oscillating frequency is feedback, and a frequency detecting circuit 43 for detecting oscillating frequency of the electronic frequency tuning magnetron 37 is provided. Signals in accordance with the frequencies detected by the detecting circuit 43 are compared with the signals from a reference frequency signal generating circuit 44 by using a comparative circuit 45. The reference frequency may be changed with time, for example, or may be constant at all times. In a tuning frequency control circuit 46, bias control signals are formed in accordance with the reference signal. The oscillation operations of the electronic frequency tuning magnetron 37 are controlled by slowing a bias current to the switching elements 18, 29 from the tuning frequency control circuit 46. In the example, stable oscillating frequency is outputted on the basis of the feedback frequencies. The above-mentioned explanations are made on the basis of vane strap magnetrons which are most commonly used. However, it is understood that the configuration of the present invention can also be applied to such as hole and slot magnetrons, coaxial magnetrons and rising sun magnetrons.

As explained above, the electronic frequency tuning magnetron according to Examples is provided with the switching elements 18, 29 at the outside of the tube. Therefore, there is no limitation in manufacturing a tube and the magnetron does not need to be designed on the basis of highly expensive coaxial magnetrons or magnetrons with an old-designed auxiliary resonant cavity. Thus, magnetrons with conventional simple configurations can be sufficiently used. Furthermore, an oscillating source of microwaves in which frequencies are freely changed in a wide range with an external signal to be used can be provided. Therefore, there are advantages in terms of a measure for frequency drift of a magnetron and frequency selection for interference prevention.

Though Examples of the present invention is described above, it is to be understood that the present invention is not limited only to the above-mentioned Examples, various changes and modifications may be made in the invention without departing from the spirit and scope thereof.

What is claimed is:

1. An electronic frequency tuning magnetron comprising:

an anode for forming a resonant cavity which is segmented into a plurality of spaces in an inner periphery side of a cylindrical anode shell;

a cathode provided at the center of the anode shell along its cylindrical axial direction; and an exhausted structure having a coaxial central conductor which is connected to the inside of the resonant cavity in the anode shell and is coupled to the resonant cavity in a high-frequency band;

wherein the coaxial central conductor is externally led through a wall of the exhausted structure via a through-hole, and the through-hole is closed by a dielectric portion placed between the coaxial central conductor and the wall of the exhausted structure, so as to keep a low atmosphere of the resonant cavity;

wherein a switching element is connected in series or parallel to an end or a side surface of an external conductor comprising a led portion of the coaxial central conductor or a conductor which is connected to the coaxial central conductor, the led portion being a portion led out from the exhausted structure, wherein a bias voltage is applied to a potential of the anode shell via the switching element, thereby an oscillating frequency is adjusted by varying a bias current caused by the bias voltage, and wherein the external conductor and the switching element are covered with the coaxial external conductor, and an end of the switching element is electrically led to an outside of the coaxial external conductor via a conductor without electrically touching to the coaxial external conductor.

2. The electrical frequency tuning magnetron according to claim 1, wherein a bias control circuit for flowing a current to the switching element is used, and wherein a bias current of the bias control circuit is synchronized with a pulse anode current of the magnetron, and the bias current which is changed within pulses of the anode current is supplied to the switching element.

3. The electronic frequency tuning magnetron according to claim 1, wherein a bias control circuit for flowing a current to the switching element and a detecting circuit for detecting an oscillation frequency of the magnetron are used, and wherein a bias current which is formed by comparing the oscillating frequency detected by the detecting circuit with a reference frequency is supplied to the switching element.

4. The electrical frequency tuning magnetron according to claim 1, wherein the switching element is connected substantially perpendicularly to the external conductor.

* * * * *